United States Patent [19]

Basnett

[11] Patent Number: 4,544,817

[45] Date of Patent: Oct. 1, 1985

[54] VACUUM CONTACTOR WITH KICKOUT SPRING

[75] Inventor: Robert T. Basnett, Hendersonville, N.C.

[73] Assignee: Westinghouse Electric Corp., Pittsburgh, Pa.

[21] Appl. No.: 556,258

[22] Filed: Nov. 29, 1983

[51] Int. Cl.[4] ..... H01H 9/08

[52] U.S. Cl. ..... 200/293; 200/153 G; 267/177

[58] Field of Search ..... 200/293, 153 G; 267/74, 267/173, 175, 177

[56] References Cited

U.S. PATENT DOCUMENTS

| | | | |
|---|---|---|---|
| 1,271,535 | 7/1918 | Bijur | 200/281 |
| 2,265,629 | 12/1941 | Christiansen | 267/74 |
| 2,465,621 | 3/1949 | Wheeler | 267/74 |
| 2,589,167 | 3/1952 | Valkenberg et al. | 200/280 |
| 3,224,727 | 12/1965 | Dale et al. | 267/175 |

*Primary Examiner*—Stephen Marcus
*Assistant Examiner*—Renee S. Kidorf
*Attorney, Agent, or Firm*—M. J. Moran

[57] ABSTRACT

A vacuum contactor with a kick-out spring that does not require readjustment after disassembly of internal portions of the vacuum contactor. Two separate frame members are secured fixedly against each other in register in the operational mode. The bottom portion of a vertically disposed kick-out spring is attached to a horizontal bar which captures a lever. The lever is interconnected with an electromagnet and with the contacts of a vacuum interrupter in an integrated system so that energization of the electromagnet forces the contacts to a closed state and exerts tension against the spring through the horizontal bar. Deenergization of the electromagnet allows the kick-out spring to relax its tension thus opening the aforementioned contacts. When the two frame portions are separated, the spring relaxes to a minimal tension disposition but is prevented from further relaxation because of a mechanical stop which prevents the horizontal bar from moving upwardly and yet allows the lever members to be disengaged from the horizontal bar.

3 Claims, 5 Drawing Figures

VACUUM CONTACTOR WITH KICKOUT SPRING

BACKGROUND OF THE INVENTION

1. Field of the Invention

The subject matter of this invention is related generally to motor contactors and more specifically to the kick-out spring system of a vacuum contactor.

2. Description of the Prior Art

Motor contactors are known. They are electrical devices which are used to start and stop electrical motors in response to signals from pushbuttons, limit switches and a variety of pilot devices. Contactors in general have as part thereof a circuit interrupting device. In the past, air brake circuit interrupting devices have been utilized which interrupt electrical current in an arc chute in air. More recently, vacuum circuit interrupting devices have been utilized to replace the air brake devices. The vacuum devices have a number of desirable features, one of which is relatively small contact separation when compared with the contact separation required in an air brake device. This means that smaller and more compact systems may be utilized with the attendant space savings associated therewith for any given voltage withstand rating when compared with the air brake type interrupter device. The main difference between vacuum contactors and conventional air brake contactors is that the vacuum contactor interrupts electrical current inside a vacuum chamber instead of inside of an air arc chute. The vacuum chamber typically consists of an assembly of a sealed evacuated enclosure surrounding a first fixed electrical contact and a movable electrical contact the motion of which is provided through a gas-tight flexible metallic bellows. One of the interesting characteristics of a vacuum interrupter is that the atmospheric pressure which surrounds the external portion thereof operates against the internal vacuum through the bellows thus tending to maintain the contacts in a closed state. In order to overcome this, a strong kick-out spring is utilized to assist in opening closed contacts and in keeping the open contacts in an open state. Typically, a vacuum interrupter is closed by utilizing an electromagnet to move an armature which is mechanically interlinked with the movable contact inside the vacuum chamber to cause the contact to abut or close the stationary contact. When the electromagnetic energy is removed from the electromagnet, the kick-out spring overcomes the atmospheric force and opens the contacts and keeps them open. Examples of prior art vacuum contactors may be found in the following descriptive bulletins: "Westinghouse Type SJO Vacuum Contactor", IL16-200-33 published by the Westinghouse Electric Corporation Control Division, Asheville, N.C., U.S.A. 28813, dated October 1982 and "Westinghouse Type SJA Vacuum Contactor", IL16-200-32 published by the Westinghouse Electric Corporation Control Division, Asheville, N.C., U.S.A. 28813, published November 1982. By reference to the fourth full paragraph of the left column of page 2 of the "SJA" bulletin, for example, it can be seen that the kick-out spring must be removed before the electromagnetic coil can be changed, for example. Removal of the kick-out springs of necessity requires readjustment thereof when reinstalled. It would be advantageous if electrical contactor apparatus could be found which utilize an adjusted kick-out spring and which could be disassembled without affecting the adjustment on the kick-out spring.

SUMMARY OF THE INVENTION

In accordance with the invention, there is provided an electrical contactor which includes first and second frame members, a coil spring means is adjustably attached at one portion thereof to the first frame, another portion of the coil spring means is free to move among three levels of spring tension, the least tense of the three levels being controlled by a spring travel limiting member on the first frame, the second frame has disposed thereon a set of separable contacts. There is also disposed on the second frame a lever which is pivotally disposed in mechanical cooperation with the contacts. The lever is pivotable between a first angular position which defines the contacts in a closed state and a second angular position which defines the contacts in an open state. The second frame has a force providing means thereon which cooperates with the contacts to cause the contacts to be in the closed state when the force providing means is actuated. The first frame and second frame are arrangeable in either a fixed relationship with respect to each other or a non-fixed relationship with respect to each other. The fixed relationship is indicative of an operational disposition and a non-fixed relationship is indicative to a servicing disposition. In the fixed relationship, a portion of the aforementioned lever is captured by a portion of the coil spring means of the first frame when the coil spring means is either in its highest adjustable level of tension or an intermediate adjustable level of tension. The highest adjustable level of tension is representative of the contacts being in the closed state and the intermediate adjustable level of tension is representative of the contacts being in the open state. In the non-fixed relationship for the two frames, the coil spring means is in the previously-mentioned least level of tension. The least level of tension has the characteristic of being at a greater tension value than that which requires readjustment of the spring.

BRIEF DESCRIPTION OF THE DRAWINGS

For a better understanding of the invention, reference may be had to the preferred embodiment thereof shown in the accompanying drawings in which.

DESCRIPTION OF THE PREFERRED EMBODIMENT

Figure 1:
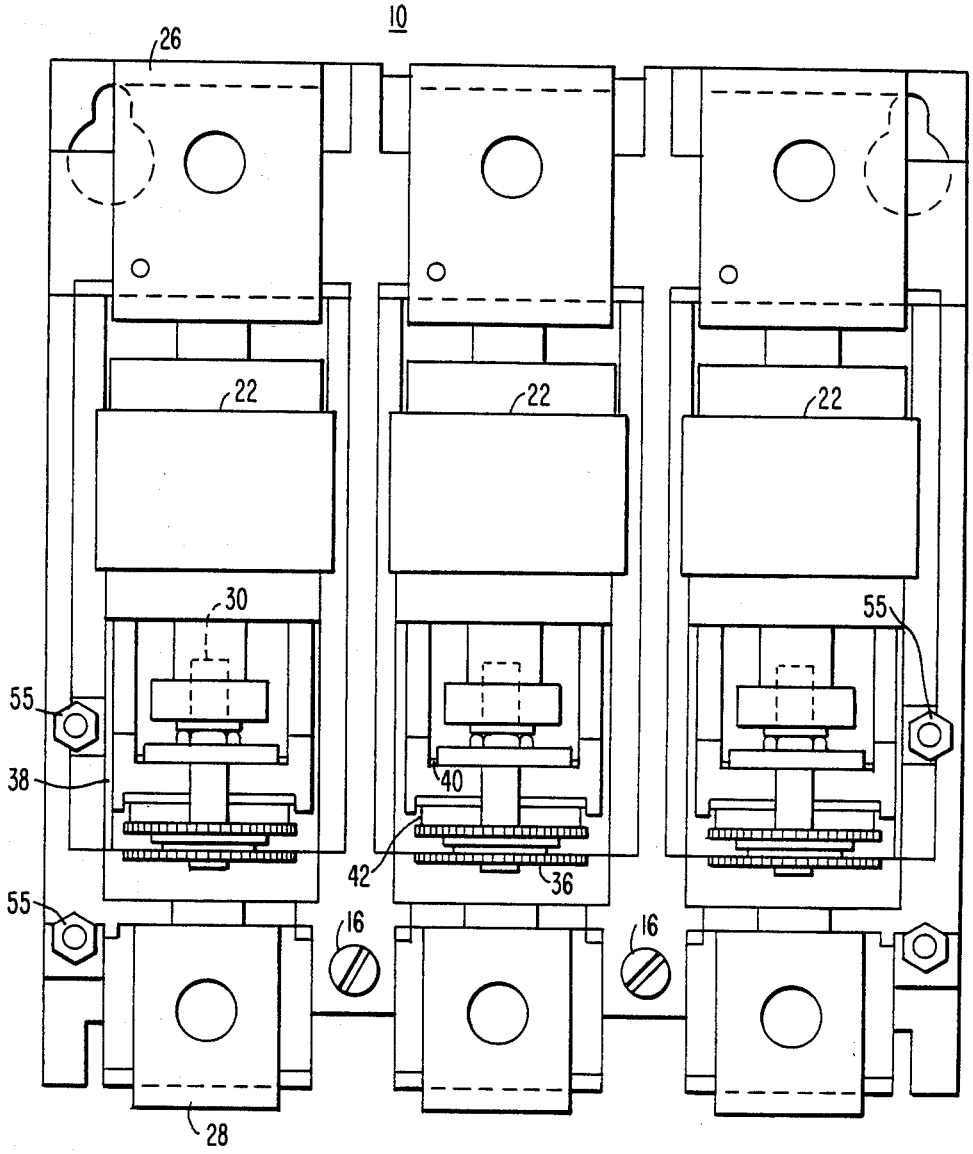
FIG. 1 shows a front elevation of a three-phase alternating current vacuum contactor utilizing the present invention.
Figure 2:
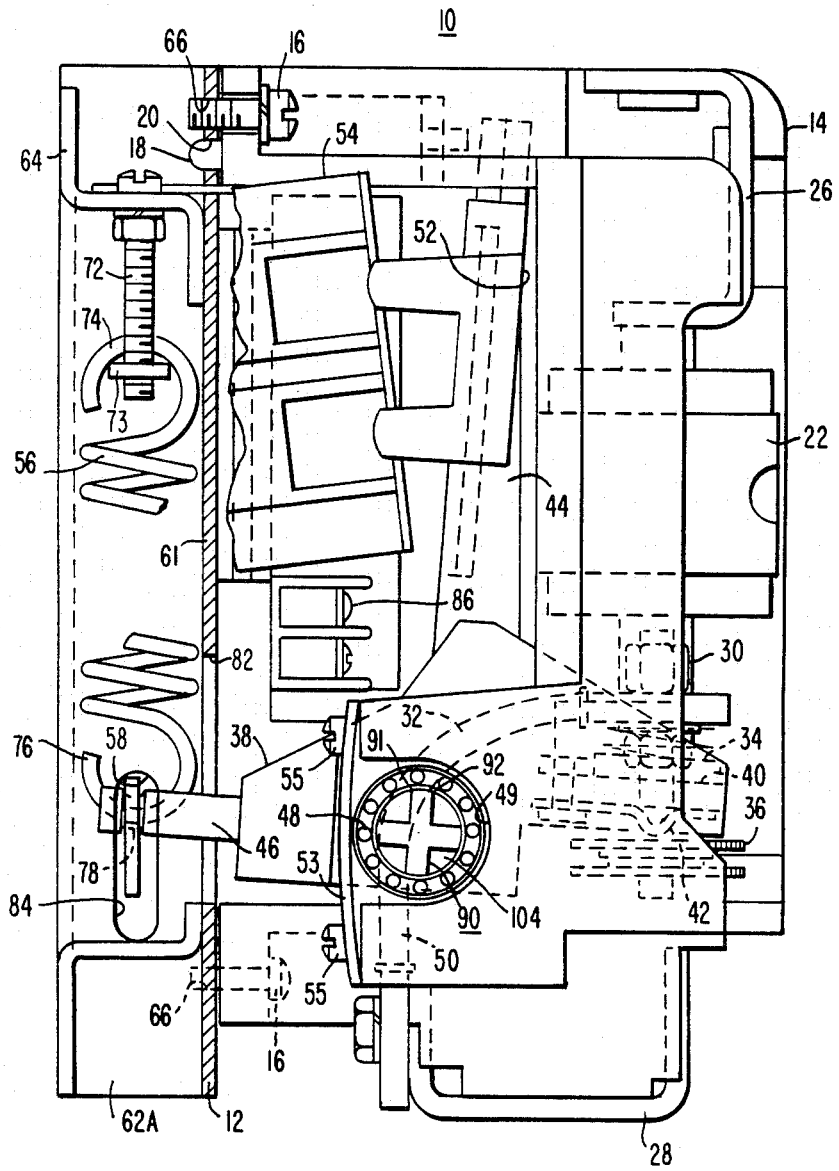
FIG. 2 shows a side elevation, partially in section and partially broken away of the vacuum contactor of FIG. 1.
Figure 3:
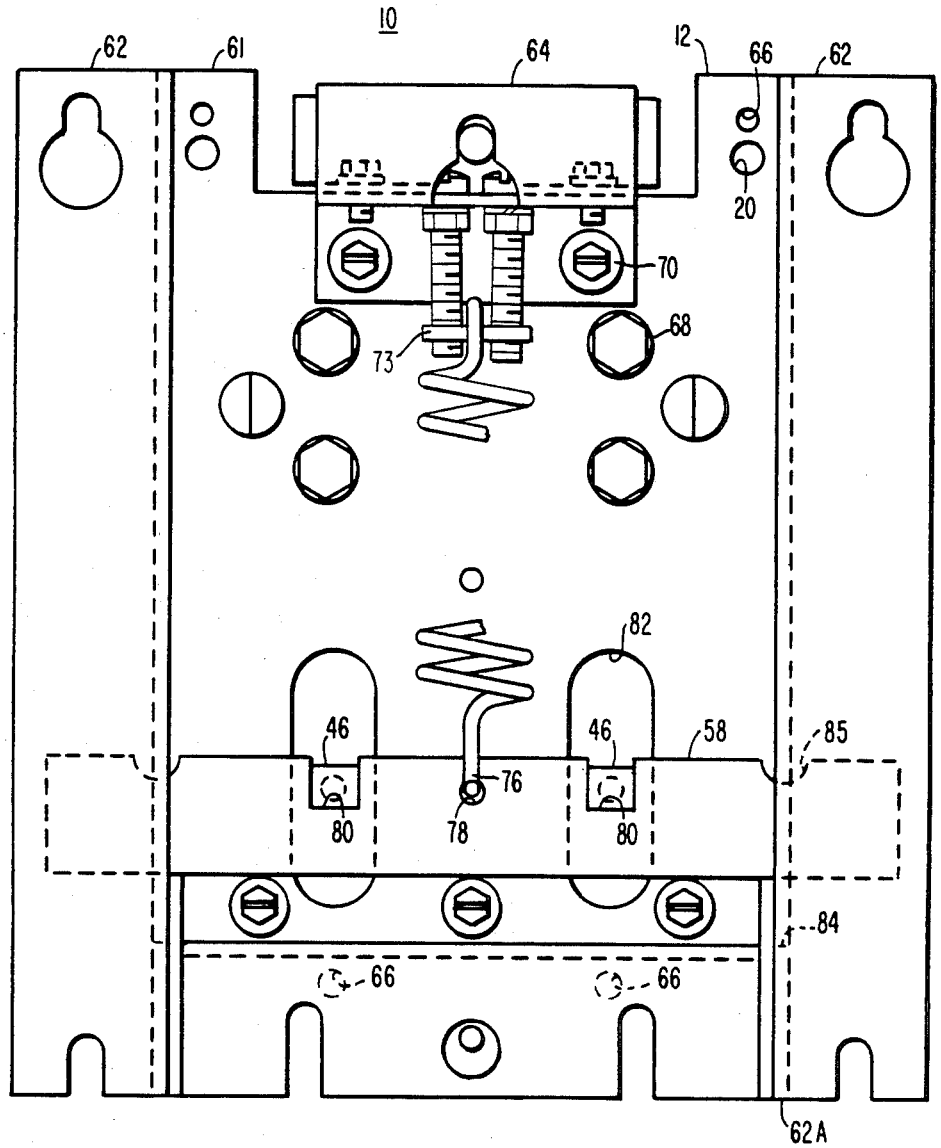
FIG. 3 shows a rear elevation of the contactor of FIGS. 1 and 2.

Referring now to the drawings and FIGS. 1 through 3 in particular, a three-phase alternating current vacuum contactor system 10 is shown. System 10 preferably includes a metal mounting plate or frame 12 to which is secured an insulating plastic frame 14. Frame 14 may be secured to the plate 12 by way of fastening screws 16 interacting with threaded holes 66 in frame 12, for example. Relative sliding motion between frame 12 and frame 14 is further prevented by means of a dowel or index ring member 18 on the frame 14 disposed in a complementary hole or opening 20 in frame 12. Three vacuum interrupters 22 are provided, one for each of the three phases of the electrical system which the contactor 22 controls. There is provided at the upper end of each interrupter 22 as viewed in FIG. 2 a first terminal 26 and at the lower end thereof a second terminal 28. Terminal 28 is electrically interconnected with a bottom movable electrically conducting stem 30 of interrupter 22 by a flexible electrical conductor 32. The vacuum interrupter 22 may be of the movable lower contact type which is well known in the art. The movable lower stem 30 has disposed as a part thereof a spring-loaded flange member 34 and a threadable flange member 36 which are utilized respectively for providing upward and downward movement, to the movable lower contact (not shown) of the vacuum circuit interrupter 22. To effectuate force for the aforementioned movement, an electrically insulating cross-bar member 38 is provided. Member 38 has an upper abutment surface 40 which abuts against the lower portion of the flexible flange member 34 and a lower U-shaped metallic bumper 42 which abuts against the upper surface of the aforementioned flange member 36. Also provided on member 38 is an upwardly extending arm 44 and a pair of outwardly extending lever members 46. The cross-bar member 38 is pivoted in a bearing assembly 48 which is disposed in a U-shaped recess 49 in insulating frame 14. Connected to the upper portion of the arm 44 is a magnetic armature 52 which is complementary with electromagnetic member 54 which is disposed on the frame 12. Also disposed on the frame 12 is an adjustable spring member 56, the lower end of which is interconnected with a link bar 58 which in turn captures the lever members 46. After the electromagnet 54 is deenergized, the force supplied by the spring 56 biases the link bar 58 upwardly against the upper end of an opening 60 in the frame 12. The captured levers 46 are biased upwardly in correspondence with the movement of the link-bar 58 to the latter position, thus causing the entire cross-bar assembly 38 to rotate in a clockwise manner on the pivot point of the bearing assembly 48, which in turn causes a downward motion of the bumper 42 against the upper surface of the flange 36, thus pulling the lower contact shaft 30 downwardly, causing an opening of the contacts of the vacuum interrupter 22. When the electromagnet 54 is energized, the armature 52 is pulled into alignment therewith, thus causing the arm 44 to rotate in a counterclockwise direction on the bearing assembly 48 against the action of the spring 56, thus causing the upper surface 40 of the crossbar 38 to push against the spring-loaded flange 34, thus causing the shaft 30 to rise to close the contacts of the vacuum circuit interrupter 22. The cross-bar assembly 38 which will be shown and described in more detail hereinafter, is joined to the insulating frame 14 by way of the twin bearing assemblies 48 at two U-shaped recesses 49. Each bearing assembly 48 is held in place by way of a flexible bridging member 53 which exerts force against the bearing assemblies 48 holding them in place in the semicircular region of the recesses 49. Bridging member 53 is secured at each end thereof to the frame 14 by way of appropriate screws or bolts 55. The arrangement of the bearing 48, the recess 49, and the bridging member 53 provides for a self-alignment of the bearing assemblies 38 within the frame 14.

Referring now particularly to FIGS. 2 and 3, the utilization of the spring member 56 and interaction thereof with the remaining portions of the assembly 10 are shown and described. Frame 12 includes a backplate 61 and two offset side portions 62. There is mounted on one surface of the backplate 61 a mounting flange 64 for the spring 56. The magnet assembly 54 is held in place against another surface of the back plate 61 by four conveniently mounted bolts 68. Flange 64 is secured against back plate 61 with bolts 70 which are not shown in FIG. 2 for convenience of illustration. Extending through the horizontal portion of flange member 64 are two slightly inwardly angled adjusting screws 72. The horizontal spring capture member 73 is disposed in threaded relationship with the two aforementioned adjusting screws 72. The upper hook end 74 of the spring 56 is captured by the member 73. Consequently, the screws 72 provide a fixed anchor for the upper portion 74 of the spring 56 and cooperate with the member 73 to provide adjustment of the spring tension of the spring 56. Disposed at the bottom of the spring 56 (as viewed in FIG. 3) is a lower hook member 76 which is captured in an opening 78 in the link-bar 58. Link-bar 58 has symmetrically disposed rectangular cutouts 80 therein which capture and hold indexed portions of the aforementioned levers 46 of the cross-bar assembly 38. Levers 46 are held in the rectangular cutouts 80 by the cooperative action of the tension of the spring 56 operating against the farthest clockwise extension of travel of the member 38 about its bearing assembly 48 as shown FIG. 2. Convenient cutouts or openings 82 are provided in the back plate 61 for accessing of the levers 46 with the link-bar 58. The vertical limits of travel of the link-bar 58 under the influence of the spring 56 are defined by the uppermost and lowermost portions of openings 84 in the transverse bridging members 62A between the backplate 61 and the offset flange members 62.

In operation, a properly adjusted spring member 56 exerts a tension force by way of link-bar 58 against the levers 46 of crossbar 38. This causes cross-bar 38 to be rotated on its bearings 48 to a position which is controlled by the contact opened disposition of the shaft 30 of the vacuum interrupters 22 as controlled at the interface of the bumper 42 and the flange screw 36 on the shaft 30. It is envisioned that at this disposition the vertical extension of the link-bar 58 is well within the constraints defined by the upper and lower limits of the openings 84. When electrical power is provided to the electromagnet 54 by way of terminals 86, for example, such as may occur if an appropriate controller relay signal is provided thereto, the armature 62 is electromagnetically brought into a disposition of close contact with the face of the electromagnet 54, causing counterclockwise rotation of the cross-bar 38 in the bearing 48 against the force of the spring 56. This causes portion 40 of cross-bar 38 to work against the bottom surface of cup-like flange 34 on the shaft 30 of the vacuum interrupter 22. This causes a closure of the aforementioned contacts. Again, the new vertical disposition of the link-bar 58 within the openings 84 is easily accommodated in this state.

Referring once again to FIGS. 1, 2 and 3, an arrangement for disassembling the frame member 14 from the frame member 12 without disturbing the adjustment of the spring 56 is depicted. As was noted previously, once the spring 56 has been adjusted by appropriate manipulation of the screws 72 with respect to the bridging member 73, for example, the spring 56 will have the highest tension in its most elongated mode when the armature 52 has been pulled against the electromagnet 54. This causes closure of the electrical contacts within the vacuum interrupter 22. The main purpose of the spring 56 in this case is to open the contacts once the energy is removed from the electromagnet 54. When this happens, the relationship between the cross-bar 38, the spring 56, the contacts of the vacuum interrupter 22 and the electromagnetic 54 is such that the spring 56 is at a second and lesser tension than described previously. Reenergization of the magnet will dispose the spring in its more elongated mode, and highest tension once again. It is desired on occasion, however, to service or otherwise obtain access to portions of assembly 10 which are not accessible without at least partial disassembly thereof. Normally, this would require disconnection of the spring 56 or sufficient reduction of the tension thereof as to render the adjustment thereof unreliable and inappropriate for further action. It is more desired to maintain the adjustment of the spring 56 even during the disassembly process if possible. And this may be done by loosening the screws 16, for example, and partially separating the frame portion 12 from the frame portion 14 so that the dowel member 18 is completely removed from its registering hole or opening 20. This allows the spring 56 to contract even farther than in the open contact state. This is accommodated by allowing the frame member 14 to translate along the interface between frame member 14 and frame member 12 in an upward direction, as shown in FIG. 2, for example. When this happens, the link-bar 58 abuts the uppermost portion of the openings 84 at recesses 85, under tension control of the spring 56. The recesses 85 prevent lateral motion of the link-bar 58 in addition to further vertical motion thereof. Once this has happened, the frame portion 14 and/or the levers 46 of cross bar 38 can be disengaged from the rectangular openings or slots 80 in the link-bar 58 and the entire frame assembly 14 can be removed from the entire frame assembly 12, thus facilitating maintenance and repair.

Figure 4:
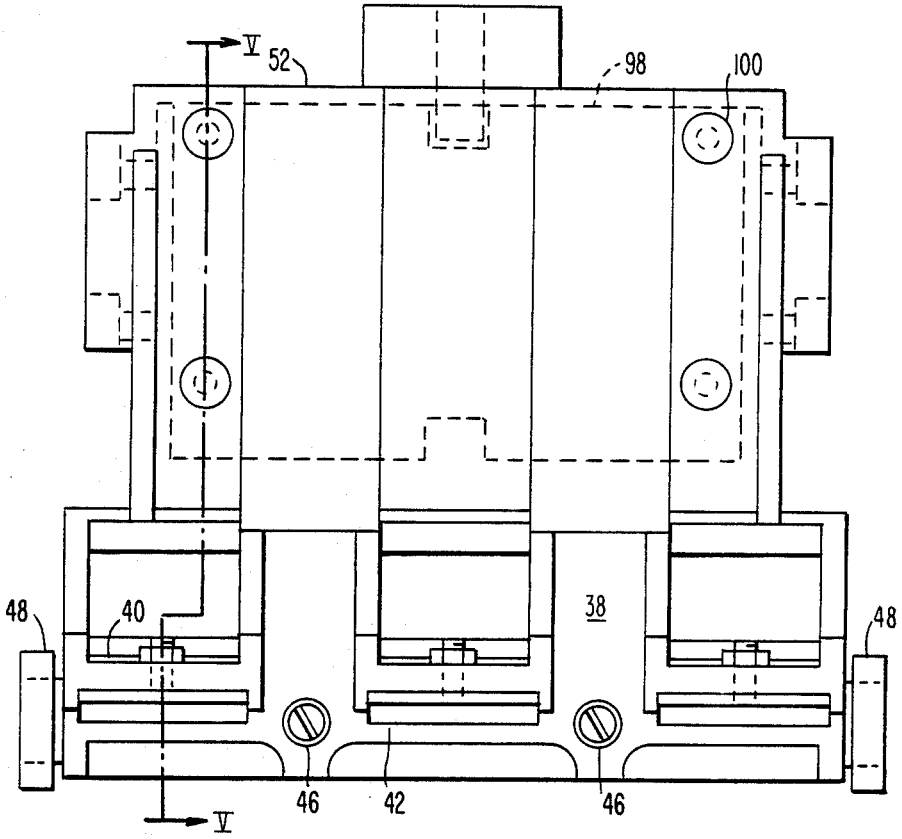
FIG. 4 shows a top view of an integral shaft and armature supporting crossbar.
Figure 5:
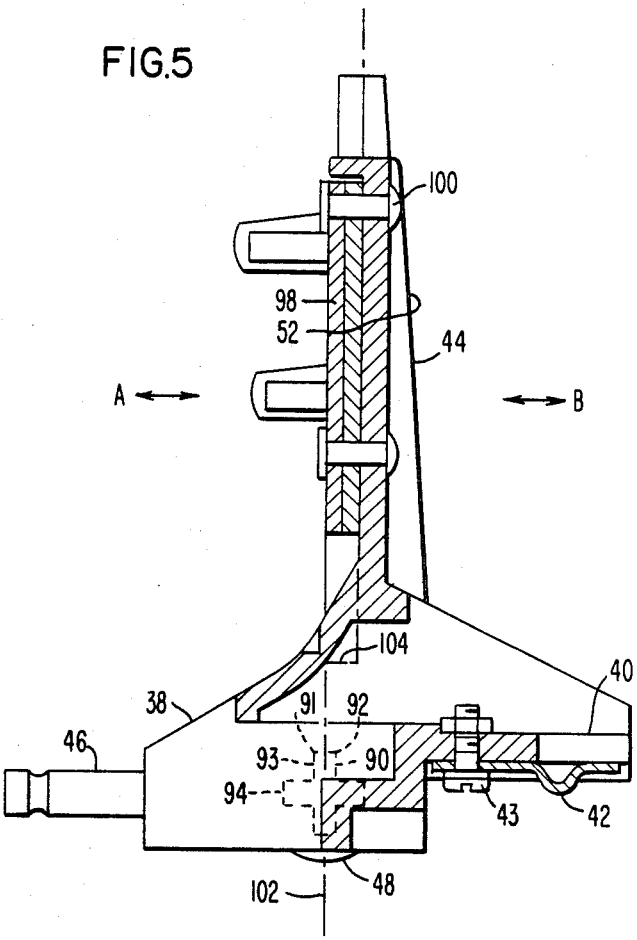
FIG. 5 shows a section of the integral shaft and armature supporting crossbar at V—V of FIG. 4.

Referring now to FIGS. 2, 4 and 5 in particular, the cross-bar 38 is shown in greater detail. Crossbar 38 includes the bearing assemblies 48 on either side thereof. The cross-bar 38 is unitary and is formed in the preferred embodiment of the invention from cast plastic material. The armature member 52 which includes plates 98 riveted to cross-bar 38 by way of rivets 100 and the bumper 42 which is appropriately bolted onto the cross-bar 38 by way of nut-and-bolt assembly 43 are added during the construction process.

The bearing assembly 48 includes ball bearings with journal and race and a cast cruciform member 90 which is molded as part of the integral cross-bar 38 during the molding process. The mold division line is represented at 102 in FIG. 5, and is shown to have a convenient step at 104. This means that complementary sections of the mold interface meet along the line 102 during the molding process. An injection molding or similar process may be used. The cruciform section 90 is cast such that one set of the cross arms 93 thereof is oriented parallel to the mold interface line 102 and one set 94 thereof is molded transverse thereto. This allows the cruciform shape to be molded conveniently, thus forming the unitary shaft relationship. The complementary mold portions are joined and pulled apart in the directions A, B, as shown in FIG. 5. It will be noted that each cruciform arm has two points—91 and 92 thereon—which abut snugly against the inner circular member of the bearing assembly 48. In that sense, the rotating shaft arrangement is completed; however, in a preferred embodiment of the invention, epoxy material is disposed in the interstices between the cruciform 90 and the inner part of the bearing assembly 48, for example, at 104, for subsequent hardening, thus forming an essentially completely filled circular inner area for the bearing assembly 48.

The apparatus taught with respect to this invention has many advantages. One advantage lies in the fact that the contactor may be disassembled for servicing without necessitating readjustment of the kick-out spring when the contactor is reassembled.

I claim:

1. An electrical contactor, comprising:

a first frame;

a coil spring adjustably attached at one end thereof to said first frame, another portion thereof being free to move among three levels of spring tension, the least tense of said three levels being defined by a spring travel limiting member on said first frame; and a second frame, said second frame having a set of separable contacts disposed thereon, said second frame having a lever pivotally disposed thereon in mechanical cooperation with said contacts, said lever being pivotable between a first angular position which defines said contacts in a closed state and a second angular position which defines said contacts in an open state, said second frame having a force providing means thereon which cooperates with said contacts to cause said contacts to be in said closed state when said force providing means is actuated, said first frame and said second frame being arrangeable in either a fixed relationship with respect to each other or a non-fixed relationship with respect to each other, said fixed relationship being indicative of an operational disposition and said non-fixed relationship being indicative of a servicing disposition, in said fixed relationship a portion of said lever being captured by said another portion of said coil spring when said coil spring is in either a highest adjustable level of spring tension or an intermediate adjustable level of spring tension, said highest adjustable level of spring tension being representative of said contacts being in said closed state and said intermediate adjustable level of tension being representative of said contacts being in said open state, in said non-fixed relationship said coil spring being in said least level of spring tension, said least level of spring tension having the characteristic of being at a greater value of spring tension than that which would require readjustment of said coil spring after said first frame and such second frame have been placed in said non-fixed disposition.

2. An electrical contactor, comprising two frames abutting each other at a common interface and having a register therebetween to prevent sliding motion along said interface, one frame having a spring therein, the other frame having contact means therein which communicates with said spring and is captured thereby for loading said spring at a first tension, partial separation of said frames sufficient to defeat said register allowing sufficient relative sliding at said interface to cause said spring to be loaded against its frame at a lesser tension and unloaded from said contact means thus allowing complete separation of said frames.

3. A process for separating a first frame of an electrical contactor from a second registered frame thereof without substantially charging the adjustment of a spring in said first frame which communicates with a contact lever in said second frame, comprising the steps of:

partially separating said first frame and said second frame in a given direction to defeat said register while maintaining said lever in a disposition of capture by said spring;

translating said first frame and said second frame relatively in a direction generally transverse to said given direction to release tension in said spring to a lesser level of tension which is defined by a spring stop on said first frame;

removing said lever from said disposition of capture; and further separating said first frame from said second frame.

* * * * *